US007032337B2

(12) United States Patent
Yang

(10) Patent No.: US 7,032,337 B2
(45) Date of Patent: Apr. 25, 2006

(54) MULTI-FUNCTION DESK CALENDAR

(76) Inventor: Hsi-Chiang Yang, No. 9, Alley 2, Lane 195, Sec. 1, Mingte Rd., Tucheng City, Taipei Hsien (TW)

( * ) Notice: Subject to any disclaimer, the term of this patent is extended or adjusted under 35 U.S.C. 154(b) by 176 days.

(21) Appl. No.: 10/826,373

(22) Filed: Apr. 19, 2004

(65) Prior Publication Data

US 2005/0229447 A1 Oct. 20, 2005

(51) Int. Cl.
*B42D 5/04* (2006.01)

(52) U.S. Cl. ..... 40/120; 40/358; D19/21; D19/23; 206/214

(58) Field of Classification Search ..... 40/120, 40/358; 206/214, 224, 338, 371; 220/529; 211/69.1; D19/21, 22, 23, 75, 76
See application file for complete search history.

(56) References Cited

U.S. PATENT DOCUMENTS

D186,144 S * 9/1959 Daniel ..... D19/22
D250,437 S * 12/1978 Korpijaakko et al. ..... D6/397
D256,809 S * 9/1980 Evenson ..... D19/75
D266,675 S * 10/1982 Polhemus et al. ..... D19/22
4,475,022 A * 10/1984 Polhemus et al. ..... 200/214
D288,287 S * 2/1987 Screen ..... D8/375
4,844,644 A * 7/1989 Roberts ..... 402/70
5,163,549 A * 11/1992 Hayduchok ..... 206/214
D339,161 S * 9/1993 Evenson ..... D19/21
5,537,369 A * 7/1996 Wu ..... 368/10

* cited by examiner

*Primary Examiner*—Cassandra Davis
(74) *Attorney, Agent, or Firm*—Bacon & Thomas PLLC

(57) ABSTRACT

A desk calendar has a base, a calendar page binder, two end blocks and a central block. The base has a top, a rear end, two sides, an auxiliary appliance stand and a channel. The auxiliary appliance stand is formed on the top to provide a place for an auxiliary appliance. The channel is defined in the top along the rear end of the base. The calendar page binder is mounted on the top of the base adjacent to the auxiliary appliance stand to hold calendar pages. The end blocks are securely mounted respectively in the ends of the channel. The central block is mounted in the channel between the end blocks to define two spaces respectively between the central block and the end blocks and has at least one pen hole.

15 Claims, 4 Drawing Sheets

MULTI-FUNCTION DESK CALENDAR

BACKGROUND OF THE INVENTION

1. Field of the Invention

The present invention relates to a desk calendar, and more particularly to a multi-function desk calendar that is versatile in use.

2. Description of Related Art

A desk calendar is used to record items of interest and is always put on a desk or a table so a person can conveniently check his or her schedule on the desk calendar. However, the conventional desk calendar has only a single function of recording items of interest and cannot provide another function to a user so the use of the conventional desk calendar is not versatile.

To overcome the shortcomings, the present invention provides a desk calendar to mitigate or obviate the aforementioned problems.

SUMMARY OF THE INVENTION

The main objective of the invention is to provide a desk calendar that is multi-functional and versatile in use. The desk calendar has a base, a calendar page binder, two end blocks and a central block. The base has a top, a rear end, two sides, an auxiliary appliance stand and a channel. The auxiliary appliance stand is formed on the top to hold an auxiliary appliance. The channel is defined in the top alongside of the rear end of the base and has an inner surface and two ends. The calendar page binder is mounted on the top of the base and is adjacent to the auxiliary appliance stand to hold calendar pages. The end blocks are securely mounted respectively in the ends of the channel. The central block is mounted in the channel between the end blocks to define two spaces respectively between the central block and the end blocks and has a top and at least one pen hole defined in the top of the central block.

Other objects, advantages and novel features of the invention will become more apparent from the following detailed description when taken in conjunction with the accompanying drawings.

DETAILED DESCRIPTION OF PREFERRED EMBODIMENT

Figure 1:
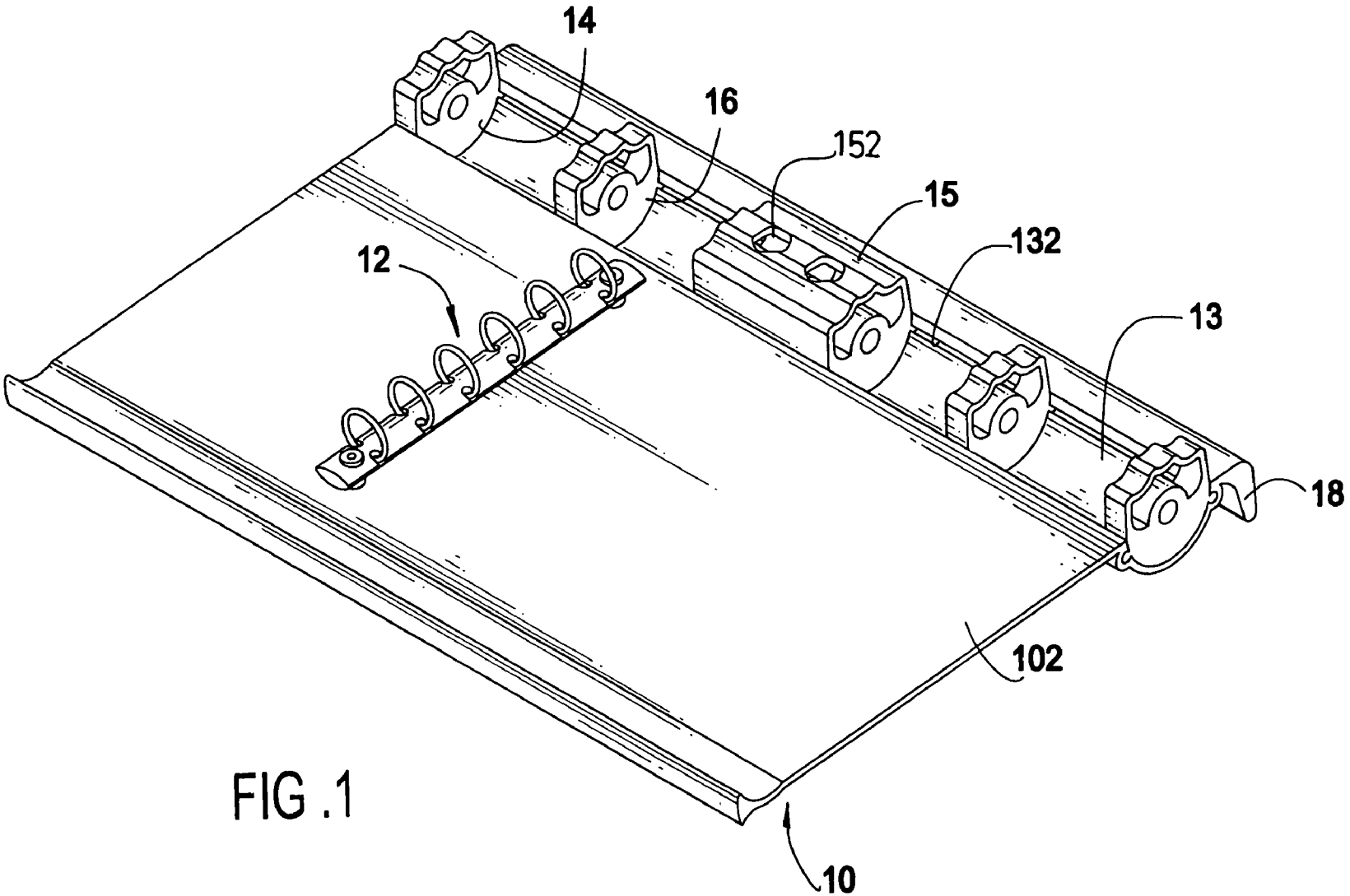
FIG. 1 is a perspective view of a desk calendar in accordance with the present invention.
Figure 2:
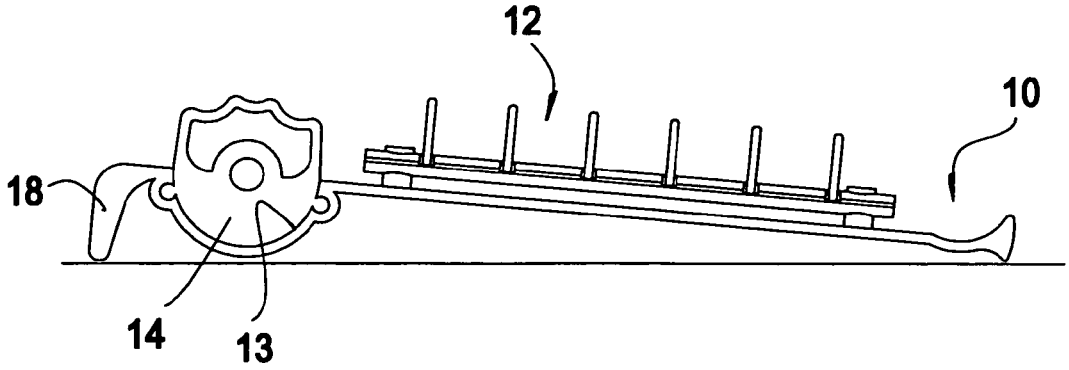
FIG. 2 is a side view of the desk calendar in FIG. 1.

With reference to FIGS. 1 to 4, a desk calendar in accordance with the present invention comprises a base (10), a calendar page binder (12), two end blocks (14), a central block (15), two optional dividers (16) and two optional supporting legs (19).

The base (10) has a top (not numbered), a rear end (not numbered), two sides (not numbered), an auxiliary appliance stand (102), a channel (13) and an optional extension (18). The auxiliary appliance stand (102) is formed on the top to provide a place for an auxiliary appliance (40). The auxiliary appliance (40) can be a calculator, a personal digital assistance (PDA) and so on that can be attached securely to the auxiliary appliance stand (102) with adhesive tape or glue. The channel (13) is defined in the top along the rear end of the base (10) and has an internal cross section (not numbered), an inner surface (not numbered), two ends (not numbered) and two optional longitudinal grooves (132). The longitudinal grooves (132) are defined in the inner surface of the channel (13) parallel to each other.

The optional extension (18) extends at an angle from the rear end of the base (10) and holds the base (10) at a desired angle relative to a flat surface, such as a desktop.

The calendar page binder (12) is mounted on the top of the base (10), is adjacent to the auxiliary appliance stand (102) and holds calendar pages (30). Accordingly, a person can record things on the calendar pages (30) and conveniently check his or her schedule.

The end blocks (14) have a cross section, an outer edge (not numbered) and two optional longitudinal ribs (not numbered) and are securely mounted respectively in and close the ends of the channel (13). The cross section corresponds to and mates with the cross section of the channel (13). The longitudinal ribs are formed on the outer edge and correspond to the longitudinal grooves (132) in the channel (13).

The central block (15) has a cross section, a top (not numbered), an outer edge (not numbered), at least one pen hole (152) and two optional longitudinal ribs (not numbered) and is mounted in the channel (13) between the end blocks (14). The central block (15) divides the channel (13) into two spaces (not numbered) between the end blocks (14). The cross section corresponds to and mates with the cross section of the channel (13). The longitudinal ribs may be formed on the outer edge and correspond to, mate with and slidably mount in the longitudinal grooves (132) in the channel (13). Desk supplies, such as staples, paper clips, thumbtacks, etc. can be placed respectively in the spaces in the channel (13), and a person can easily and conveniently find and remove the desk supplies. A pen (50) can be inserted into and held in one of the pen holes (15) so the pen (50) is readily available to a user without cluttering a desk or tabletop.

The optional dividers (16) have a cross section, an outer edge (not numbered) and two optional longitudinal ribs (162) and are mounted slidably in the channel (13) in the spaces to form additional storage spaces (not numbered) for storing different desk supplies. The cross section corresponds to and mates with the cross section of the channel (13). The longitudinal ribs may be formed on the outer edge and correspond to, mate with and slidably mount in the longitudinal grooves (132) in the channel (13).

Figure 5:
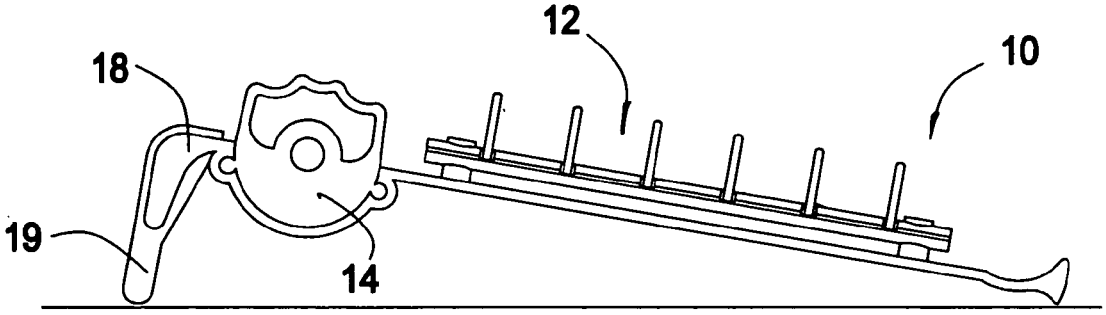
FIG. 5 is a side view of the desk calendar in FIG. 3.
Figure 3:
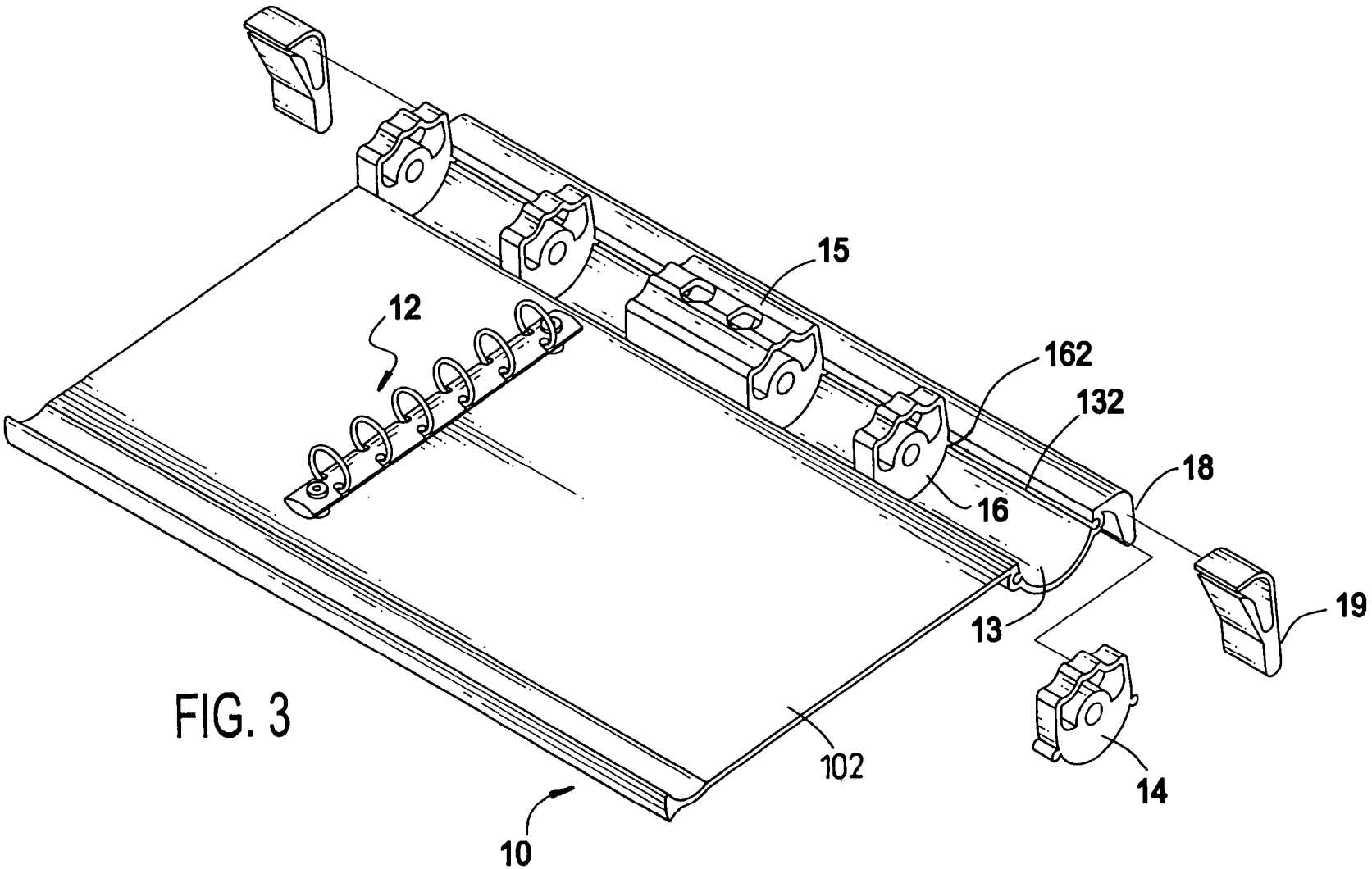
FIG. 3 is an exploded perspective view of the desk calendar in FIG. 1 with two optional supporting legs.
Figure 4:
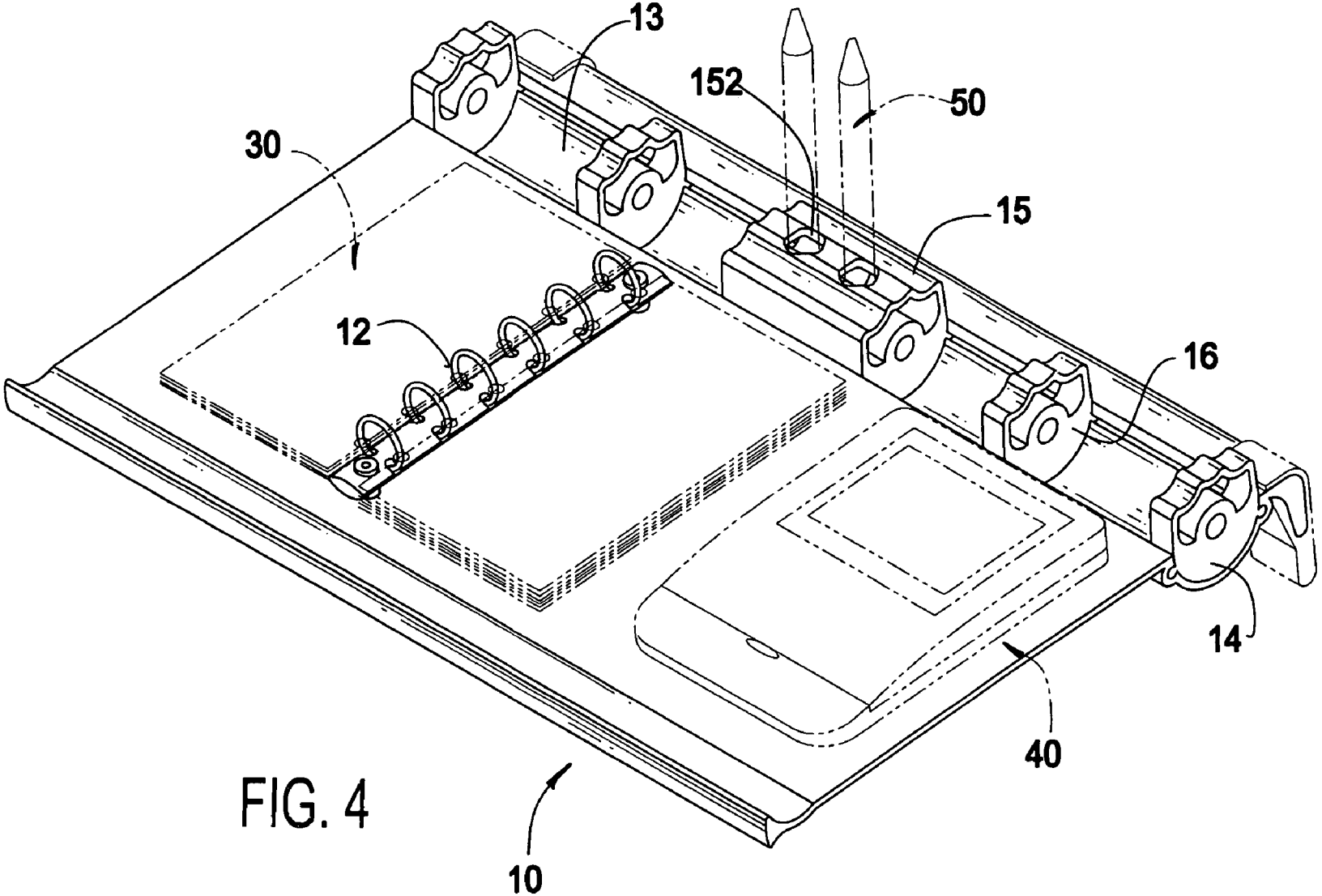
FIG. 4 is an operational perspective view of the desk calendar in FIG. 3.

With reference further to FIG. 5, the optional supporting legs (19) are slidably attached to the extension (18) to change the angle of the base (10) to accommodate the needs or customs of different users.

As described, the desk calendar has multiple functions so a person can conveniently deal with office or daily affairs, and the desk calendar is versatile.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A desk calendar comprising:

a base having a top, a rear end, two sides, an auxiliary appliance stand formed on the top to provide a place for an auxiliary appliance and a channel with an internal cross section, an inner surface defined in the top along the rear end and two ends;

a calendar page binder mounted on the top of the base and adjacent to the auxiliary appliance stand to hold calendar pages;

two end blocks having an outer edge and securely being mounted respectively in and closing the ends of the channel; and a central block having a top, an outer edge and at least one pen hole and being mounted in the channel between the end blocks to divide the channel into two spaces respectively between the central block and the end blocks.

2. The desk calendar as claimed in claim 1 further comprising two dividers having a cross section slidably mounted in the channel and respectively in the spaces.

3. The desk calendar as claimed in claim 2, wherein the end blocks, the central block and the dividers have the same cross section.

4. The desk calendar as claimed in claim 3, wherein the channel has two longitudinal grooves defined in the inner surface of the channel in parallel to each other; and each divider has two longitudinal ribs formed on an outer edge and corresponding to and sliding respectively in the longitudinal grooves in the inner surface of the channel.

5. The desk calendar as claimed in claim 4 further comprising an extension extending at an angle from the rear end of the base.

6. The desk calendar as claimed in claim 5 further comprising multiple supporting legs slidably attached to the extension.

7. The desk calendar as claimed in claim 1, wherein the end blocks, the central block and at least one divider have the same cross section.

8. The desk calendar as claimed in claim 7, wherein the channel has two longitudinal grooves defined in the inner surface of the channel in parallel to each other; and each divider has two longitudinal ribs formed on an outer edge and corresponding to and sliding respectively in the grooves in the inner surface of the channel.

9. The desk calendar as claimed in claim 8 further comprising an extension extending at an angle from the rear end of the base.

10. The desk calendar as claimed in claim 9 further comprising multiple supporting legs slidably attached to the extension.

11. The desk calendar as claimed in claim 1, wherein the channel has two longitudinal grooves defined in the inner surface of the channel in parallel to each other; and at least one divider has two longitudinal ribs formed on an outer edge and corresponding to and sliding respectively in the longitudinal grooves in the inner surface of the channel.

12. The desk calendar as claimed in claim 11 further comprising an extension extending at an angle from the rear end of the base.

13. The desk calendar as claimed in claim 12 further comprising multiple supporting legs slidably attached to the extension.

14. The desk calendar as claimed in claim 1 further comprising an extension extending at an angle from the rear end of the base.

15. The desk calendar as claimed in claim 14 further comprising multiple supporting legs slidably attached to the extension.

* * * * *